US011578898B2

(12) United States Patent
Shin et al.

(10) Patent No.: US 11,578,898 B2
(45) **Date of Patent: *Feb. 14, 2023**

(54) AIR CONDITIONING APPARATUS

(71) Applicant: LG Electronics Inc., Seoul (KR)

(72) Inventors: Ilyoong Shin, Seoul (KR); Yongcheol Sa, Seoul (KR); Chiwoo Song, Seoul (KR); Jisung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 167 days.

This patent is subject to a terminal disclaimer.

(21) Appl. No.: 16/808,047

(22) Filed: Mar. 3, 2020

(65) Prior Publication Data

US 2020/0309418 A1 Oct. 1, 2020

(30) Foreign Application Priority Data

Mar. 27, 2019 (KR) ..... 10-2019-0035169

(51) Int. Cl.
*F25B 13/00* (2006.01)

(52) U.S. Cl.
CPC ..... *F25B 13/00* (2013.01); *F25B 2313/003* (2013.01); *F25B 2313/0233* (2013.01)

(58) Field of Classification Search
CPC ..... F25B 13/00; F25B 2313/003; F25B 2313/0233; F25B 2313/007; F25B 2313/0231; F25B 49/02; F25B 2339/047; F25B 25/005; F25B 2600/2513; F25B 2600/2519; F25B 2600/2501; F25B 41/40;

(Continued)

(56) References Cited

U.S. PATENT DOCUMENTS

2008/0196432 A1 8/2008 Shimamoto et al.
2009/0007589 A1 1/2009 Takegami et al.

(Continued)

FOREIGN PATENT DOCUMENTS

CN 1517632 8/2004
CN 105605816 5/2016

(Continued)

OTHER PUBLICATIONS

Machida, Air Conditioner, Sep. 19, 2013, JP2013185739A, Whole Document (Year: 2013).*

(Continued)

*Primary Examiner* — Larry L Furdge
(74) *Attorney, Agent, or Firm* — Fish & Richardson P.C.

(57) ABSTRACT

An air conditioning apparatus includes an outdoor unit configured to circulate refrigerant, an indoor unit configured to circulate water, and a heat exchange device that connects the indoor unit to the outdoor unit and that is configured to perform heat exchange between the refrigerant and the water. The heat exchange device includes a first heat exchanger and a second heat exchanger, a first refrigerant pipe and a second refrigerant pipe that are connected to the first heat exchanger, a third refrigerant pipe and a fourth refrigerant pipe that are connected to the second heat exchanger, a first expansion valve disposed at the second refrigerant pipe, a second expansion valve disposed at the fourth refrigerant pipe, a bypass pipe that connects the second refrigerant pipe to the third refrigerant pipe, and a bypass valve disposed at the bypass pipe.

17 Claims, 6 Drawing Sheets

(58) Field of Classification Search
CPC .... F25B 41/26; F25B 5/02; F25B 6/02; F24F 11/65; F24F 11/67; F24F 13/30; F24F 13/02; F24F 5/00; F24F 2221/54; F24F 5/001; F24F 5/0003; F24F 11/84
See application file for complete search history.

(56) References Cited

U.S. PATENT DOCUMENTS

| | | | |
|---|---|---|---|
| 2012/0198873 | A1 | 8/2012 | Yamashita et al. |
| 2013/0305758 | A1 | 11/2013 | Matsui |
| 2016/0245539 | A1 | 8/2016 | Motomura et al. |
| 2016/0245561 | A1 | 8/2016 | Tanaka |
| 2017/0219264 | A1 | 8/2017 | Song et al. |

FOREIGN PATENT DOCUMENTS

| | | | | |
|---|---|---|---|---|
| EP | 2431675 | | | 3/2012 |
| EP | 3273183 | | | 1/2018 |
| JP | H0448138 | | | 2/1992 |
| JP | H0849939 | A | * | 2/1996 |
| JP | 2001174089 | A | * | 6/2001 |
| JP | 2004226015 | A | * | 8/2004 |
| JP | 2013185739 | A | * | 9/2013 |
| JP | 2016091298 | | | 5/2016 |
| KR | 20130127531 | | | 11/2013 |
| KR | 20160091298 | | | 8/2016 |
| WO | WO2011064830 | | | 6/2011 |
| WO | WO2011104869 | | | 9/2011 |
| WO | WO2010137078 | | | 11/2012 |
| WO | WO2018029817 | | | 4/2019 |

OTHER PUBLICATIONS

Aoyama et al., Regeneration Air Conditioning System, Feb. 20, 1996, JPH0849939A, Whole Document (Year: 1996).*
Yoshiro et al., Cold Water/Hot Water Feed System, Aug. 12, 2004, JP2004226015A, Whole Document (Year: 2004).*
Koizumi, Multiple Chamber Type Air Conditioner, Jun. 29, 2001, JP2001174089A, Whole Document (Year: 2001).*
Extended European Search Report in European Appln. No. 20158212.9, dated Jul. 29, 2020, 4 pages.
PCT International Search Report in International Application No. PCT/KR2019/017548, dated Mar. 27, 2020, 3 pages.
Office Action in Chinese Appln. No. 201980094383.4, dated Jul. 5, 2022, 24 pages (with English translation).
Office Action in Japanese Appln. No. 20215-57576, dated Sep. 27, 2022, 10 pages (with English translation).

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0035169, filed on Mar. 27, 2019, which is hereby incorporated by reference in its entirety.

TECHNICAL FIELD

The present disclosure relates to an air conditioning apparatus.

BACKGROUND

Air conditioning apparatuses may maintain air in a space to be a proper state according to the use and purpose thereof. In some examples, an air conditioning apparatus may include a compressor, a condenser, an expansion device, and evaporator. The air conditioning apparatus may run a refrigerant cycle including compression, condensation, expansion, and evaporation processes with refrigerant to cool or heat a space.

The air conditioning apparatus may be used in various places. For example, the air conditioning apparatus may be used in a home or an office.

In some cases, when the air conditioning apparatus performs a cooling operation, an outdoor heat exchanger provided in an outdoor unit may serve as a condenser, and an indoor heat exchanger provided in an indoor unit may serve as an evaporator. In some cases, when the air conditioning apparatus performs a heating operation, the indoor heat exchanger may serve as the condenser, and the outdoor heat exchanger may serve as the evaporator.

Recently, the type of refrigerant used in the air conditioning apparatus and an amount of used refrigerant may be limited according to environmental regulations.

In some cases, a technique for performing cooling or heating by performing heat-exchange between a refrigerant and a predetermined fluid may be used to reduce an amount of used refrigerant. For example, the predetermined fluid may include water.

In some cases, in a plate-type heat exchanger, refrigerant and water may exchange heat with each other to generate heat, thereby cooling, heating, or supplying hot water or cold water. In some cases, a refrigerant flow path may be fixed in the same manner regardless of whether the plate-type heat exchanger functions as a condenser or an evaporator, which may deteriorate heat exchange performance.

In some cases, when the plate-type heat exchanger acts as a condenser, it may be advantageous to reduce the number of refrigerant flow paths and to increase in length of the refrigerant flow path so as to increase in condensation performance. In some cases, when the plate-type heat exchanger acts as an evaporator, it may be advantageous to increase in number of refrigerant flow paths and reduce a length of the refrigerant flow paths so as to prevent a pressure loss from occurring, i.e., prevent an evaporation pressure from being reduced.

SUMMARY

The present disclosure describes an air conditioning apparatus in which a refrigerant flow path in a heat exchange device may vary to improve performance during a cooling operation or a heating operation.

The present disclosure describes an air conditioning apparatus in which, when a plurality of heat exchangers, which are provided in a heat exchange device, serve as evaporators during a cooling operation, a refrigerant is branched and introduced into the plurality of heat exchangers to increase in number of refrigerant flow paths and decrease in length of each of the refrigerant flow path (parallel connection between the heat exchangers), thereby preventing an evaporation pressure from being reduced during a cooling operation.

The present disclosure describes an air conditioning apparatus in which, when a plurality of heat exchangers serve as condensers, a refrigerant sequentially passes through the plurality of heat exchangers to increase in length of a refrigerant flow path and decrease in number of refrigerant flow paths (series connection between the heat exchangers), thereby improving condensation performance in the heat exchangers during a heating operation.

According to one aspect of the subject matter described in this application, An air conditioning apparatus includes an outdoor unit configured to circulate refrigerant, an indoor unit configured to circulate water, and a heat exchange device that connects the indoor unit to the outdoor unit and that is configured to perform heat exchange between the refrigerant and the water. The heat exchange device includes a first heat exchanger and a second heat exchanger, a first refrigerant pipe and a second refrigerant pipe that are connected to the first heat exchanger, a third refrigerant pipe and a fourth refrigerant pipe that are connected to the second heat exchanger, a first expansion valve disposed at the second refrigerant pipe, a second expansion valve disposed at the fourth refrigerant pipe, a bypass pipe that connects the second refrigerant pipe to the third refrigerant pipe, and a bypass valve disposed at the bypass pipe.

Implementations according to this aspect may include one or more of the following features. For example, the first heat exchanger may define a first refrigerant flow path that is configured to circulate the refrigerant and that includes the first refrigerant pipe and the second refrigerant pipe, and the bypass pipe may be connected to a portion between the first expansion valve and the first refrigerant flow path at the second refrigerant pipe.

In some implementations, the air conditioning apparatus may further include a check valve that is disposed at the third refrigerant pipe or that is disposed at a pipe that connects the third refrigerant pipe to the first refrigerant pipe. In some examples, the check valve may be configured to restrict flow of the refrigerant from the first refrigerant pipe to the third refrigerant pipe and to allow flow of the refrigerant from the third refrigerant pipe to the first refrigerant pipe.

In some implementations, the indoor unit may be configured to perform a cooling operation in a state in which the first expansion valve and the second expansion valve are opened, and the bypass valve is closed. The first heat exchanger may be configured to, based on the indoor unit performing the cooling operation, receive the refrigerant from the outdoor unit through the second refrigerant pipe and supply the refrigerant from the second refrigerant pipe to the first refrigerant pipe, and the second heat exchanger may be configured to, based on the indoor unit performing the cooling operation, receive the refrigerant discharged from the outdoor unit through the fourth refrigerant pipe and supply the refrigerant from the fourth refrigerant pipe to the third refrigerant pipe.

In some implementations, the check valve may be configured to, based on the indoor unit performing the cooling operation, be opened to transmit the refrigerant discharged from the second heat exchanger to the first heat exchanger.

In some implementations, the heat exchange device may be configured to, based on the indoor unit performing the cooling operation, operate the second heat exchanger while the first heat exchanger is not operated in a state in which the second expansion valve is opened, and the first expansion valve and the bypass valve are closed. In some examples, the check valve may be configured to, in a state in which the second heat exchanger is operated and the first heat exchanger is not operated, be opened to transmit the refrigerant from the second heat exchanger to the first heat exchanger.

In some implementations, the heat exchange device may be configured to, based on the indoor unit performing the cooling operation, operate the first heat exchanger while the second heat exchanger is not operated in a state in which the first expansion valve is opened, and the second expansion valve and the bypass valve are closed.

In some implementations, the indoor unit may be configured to perform a heating operation in a state in which the first expansion valve is closed and the second expansion valve and the bypass valve are opened, and the heat exchange device may be configured to, based on the indoor unit performing the heating operation, supply the refrigerant from the first heat exchanger to the second heat exchanger.

In some implementations, the indoor unit may be configured to perform a heating operation in a state in which the first expansion valve is opened and the second expansion valve and the bypass valve are closed, and the heat exchange device may be configured to, based on the indoor unit performing the heating operation, operate one of the first heat exchanger or the second heat exchanger.

In some implementations, the first heat exchanger may define a first water flow path that is configured to circulate the water to exchange heat with the refrigerant in the first refrigerant flow path, and the second heat exchanger may define a second water flow path that is configured to circulate the water to exchange heat with the refrigerant in the second heat exchanger. In the same or other implementations, the indoor unit may be configured to receive the water through the first water flow path and the second water flow path.

In some implementations, the air conditioning apparatus may further include a first connection pipe that is connected to the outdoor unit and that is configured to guide the refrigerant in a high-pressure gas state, a second connection pipe that is connected to the outdoor unit and that is configured to guide the refrigerant in a low-pressure gas state, and a third connection pipe that is connected to the outdoor unit and that is configured to guide the refrigerant in a liquid state.

In some implementations, the air conditioning apparatus may further include a first branch pipe connected to the first connection pipe, a second branch pipe connected to the second connection pipe, and a common gas pipe disposed between the first branch pipe and the second branch pipe, where the common gas pipe has a first end that is connected to the first branch pipe and to the second branch pipe and a second end that is connected to the first refrigerant pipe and to the third refrigerant pipe.

In some implementations, the third connection pipe may be connected to the second refrigerant pipe and to the fourth refrigerant pipe. In some implementations, the air conditioning apparatus may further include a first valve disposed at the first branch pipe, and a second valve disposed at the second branch pipe.

According to another aspect, an air conditioning apparatus includes an outdoor unit configured to circulate refrigerant, a plurality of indoor units configured to circulate water, and a heat exchange device that connects the outdoor unit to the plurality of indoor units and that is configured to perform heat exchange between the refrigerant and the water. The heat exchange device includes a plurality of heat exchangers, where each of the plurality of heat exchangers includes a refrigerant flow path and a water flow path, a refrigerant passage defined by the refrigerant flow path of each of the plurality of heat exchangers and configured to allow each of the plurality of heat exchangers to operate as an evaporator or a condenser, and a water passage defined by the water flow path of each of the plurality of heat exchangers and configured to allow the plurality of indoor units to perform a cooling operation or a heating operation. The water passage is configured to, based on the plurality of indoor units performing the heating operation, be varied to supply the water to a heat exchanger among the plurality of heat exchangers that is operated as the condenser, and, based on the plurality of indoor units performing the cooling operation, be varied to supply the water to a heat exchanger among the plurality of heat exchangers that is operated as the evaporator.

Implementations according to this aspect may include one or more of the following features. For example, the refrigerant passage may be configured to, based on the plurality of indoor units performing the cooling operation, be varied to circulate the refrigerant parallely through the plurality of heat exchangers, and, based on the plurality of indoor units performing the heating operation, be varied to circulate the refrigerant sequentially through the plurality of heat exchangers.

In some implementations, each of the water passage and the refrigerant passage may include a plurality of pipes and a plurality of valves. In some implementations, the air conditioning apparatus may further include a pump that is connected to the plurality of indoor units and that is configured to supply the water to the plurality of heat exchangers.

The details of one or more implementations are set forth in the accompanying drawings and the description below. Other features will be apparent from the description and drawings, and from the claims.

DETAILED DESCRIPTION

Figure 1:
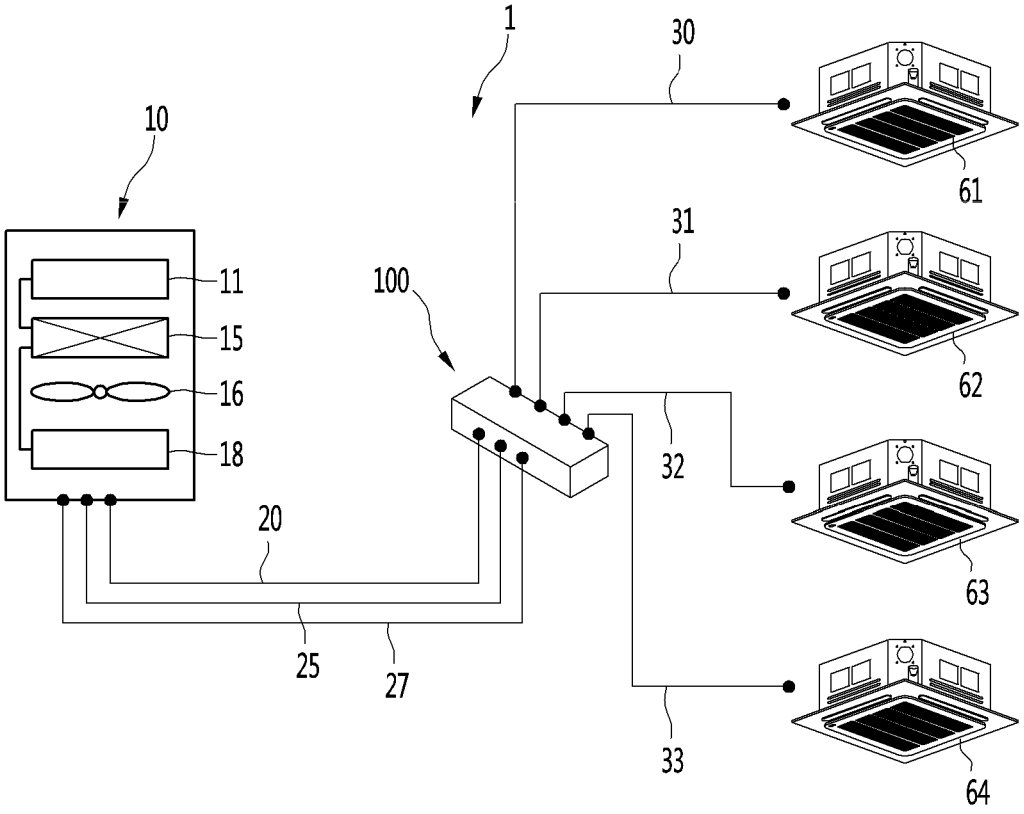
FIG. 1 is a schematic view illustrating an example configuration of an air conditioning apparatus.

Hereinafter, one or more implementations of the present disclosure will be described in detail with reference to the accompanying drawings. Exemplary implementations of the present disclosure will be described below in more detail with reference to the accompanying drawings. It is noted that the same or similar components in the drawings are designated by the same reference numerals as far as possible even if they are shown in different drawings. Further, in description of implementations of the present disclosure, when it is determined that detailed descriptions of well-known configurations or functions disturb understanding of the implementations of the present disclosure, the detailed descriptions will be omitted.

Figure 2:
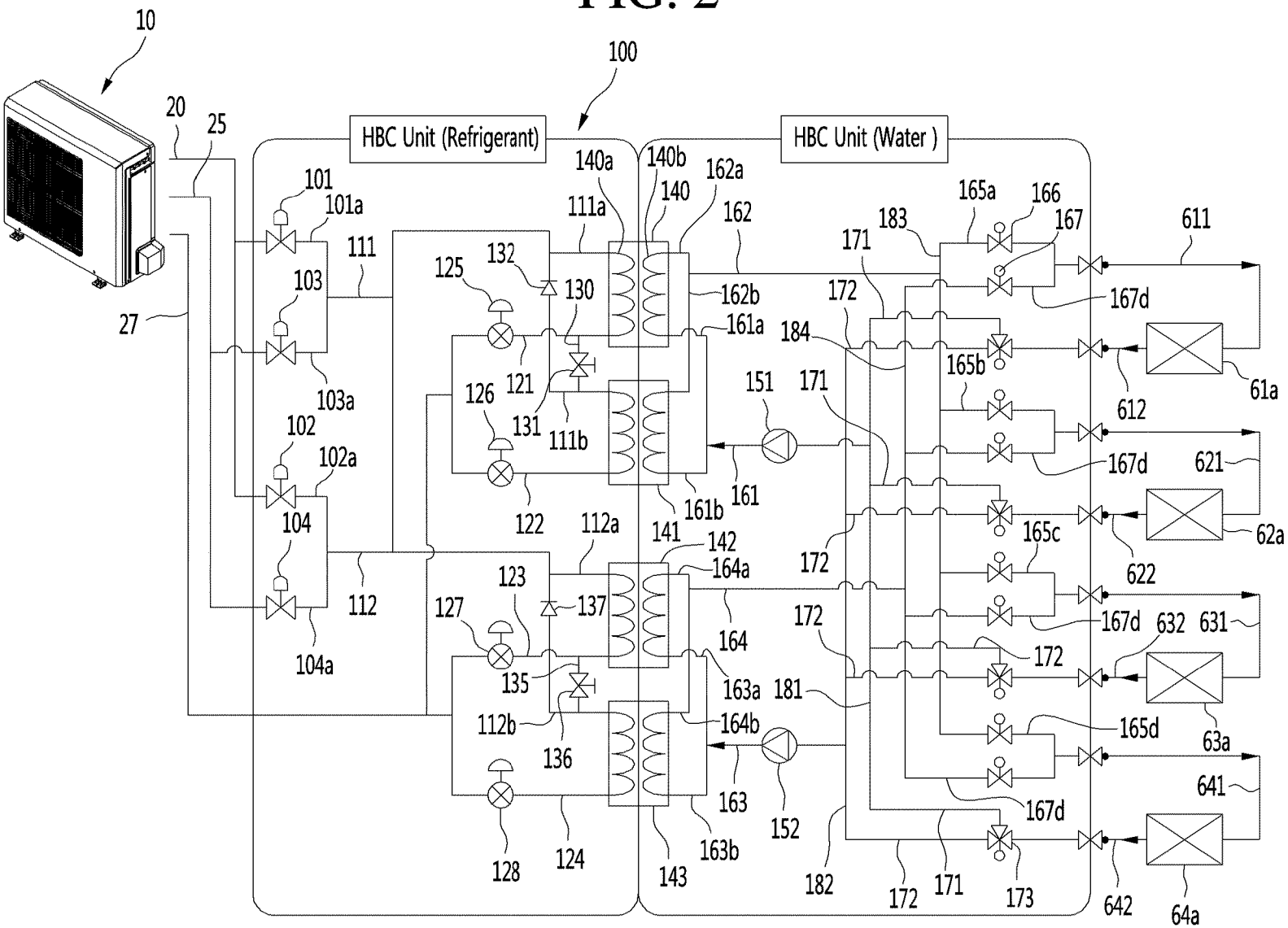
FIG. 2 is a cycle diagram illustrating the configuration of the air conditioning apparatus.

FIG. 1 is a schematic view illustrating an example configuration of an air conditioning apparatus, and FIG. 2 is a cycle diagram illustrating the configuration of the air conditioning apparatus.

Referring to FIGS. 1 and 2, an air conditioning apparatus 1 is connected to an outdoor unit 10, an indoor unit 50, and a heat exchange device connected to the outdoor unit 10 and the indoor unit 50.

The outdoor unit 10 and the heat exchange device 100 may be fluidly connected by a first fluid. For example, the first fluid may include a refrigerant.

The refrigerant may flow through a refrigerant-side flow path of a heat exchanger, which is provided in the heat exchange device 100, and the outdoor unit 10.

The outdoor unit 10 may include a compressor 11 and an outdoor heat exchanger 15.

An outdoor fan 16 may be provided at one side of the outdoor heat exchanger 15 to blow external air toward the outdoor heat exchanger 15 so that heat exchange between the external air and the refrigerant of the outdoor heat exchanger 15 is performed. The outdoor unit 10 may further include a main expansion valve 18 (EEV).

The air conditioning apparatus 1 may further include connection pipes 20, 25, and 27 connecting the outdoor unit 10 to the heat exchange device 100.

The connection pipes 20, 25, and 27 may include a first connection pipe 20 as a gas pipe (a high-pressure gas pipe) through which a high-pressure gas refrigerant flows, a second connection pipe 25 as a gas pipe (a low-pressure gas pipe) through which a low-pressure gas refrigerant flows, and a third connection pipe 27 as a liquid pipe through which a liquid refrigerant flows. In some cases, the high-pressure gas pipe may be configured to carry the refrigerant in a gas state with a first pressure, and the low-pressure gas pipe may be configured to carry the refrigerant in a gas state with a second pressure that is less than the first pressure.

In some implementations, the outdoor unit 10 and the heat exchange device 100 may have a three pipe connection structure, where the refrigerant may circulate through the outdoor unit 10 and the heat exchange device 100 by the three connection pipes 20, 25, and 27.

The heat exchange device 100 and the indoor unit 50 may be fluidly connected by a second fluid. For example, the second fluid may include water.

The water may flow through a water-side flow path of a heat exchanger, which is provided in the heat exchange device 100, and the outdoor unit 10.

The heat exchange device 100 may include a plurality of heat exchangers 140, 141, 142, and 143. Each of the heat exchangers 140, 141, 142, and 143 may include, for example, a plate heat exchanger.

The indoor unit 50 may include a plurality of indoor units 61, 62, 62, and 63. In some implementations, the number of plurality of indoor units 61, 62, 63, and 64 is not limited. In FIG. 1, for example, four indoor units 61, 62, 63, and 64 are connected to the heat exchange device 100.

The plurality of indoor units 61, 62, 63, and 64 may include a first indoor unit 61, a second indoor unit 62, a third indoor unit 63, and a fourth indoor unit 64.

The air conditioning apparatus 1 may further include pipes 30, 31, 33, and 33 connecting the heat exchange device 100 to the indoor unit 50.

The pipes 30, 31, 32, and 33 may include first to fourth indoor unit connection pipes 30, 31, 32, and 33, which connect the heat exchange device 100 to each of indoor units 61, 62, 63 and 64.

The water may circulate through the heat exchange device 100 and the indoor unit 50 via the indoor unit connection pipes 30, 31, 32, and 33. As the number of indoor units increases, the number of pipes connecting the heat exchange device 100*a* to the indoor units may also increase.

According to the above-described configuration, the refrigerant circulating through the outdoor unit 10 and the heat exchange device 100 and the water circulating through the heat exchange device 100 and the indoor unit 50 are heat-exchanged with each other through the heat exchangers 140, 141, 142, and 143 provided in the heat exchange device 100.

The water cooled or heated through the heat-exchange may be heat-exchanged with indoor heat exchangers 61*a*, 62*a*, 63*a*, and 64*a* to perform cooling or heating in the indoor space.

The plurality of heat exchangers 140, 141, 142, and 143 may be provided in the same number as the number of plurality of indoor units 61, 62, 63, and 64. Alternatively, two or more indoor units may be connected to one heat exchanger.

Hereinafter, the heat exchange device 100 will be described in detail.

The heat exchange device 100 may include first to fourth heat exchangers 140, 141, 142, and 143 which are fluidly connected to the indoor units 61, 62, 63, and 64, respectively.

In some implementations, the first to fourth heat exchangers 140, 141, 142, and 143 may have the same structure. In other implementations, the first to fourth heat exchangers 140, 141, 142, and 143 may have different structures.

Each of the heat exchangers 140, 141, 142, and 143 may include a plate heat exchanger, for example, and the water flow path and the refrigerant flow path may be alternately stacked. In some examples, each of the heat exchangers 140, 141, 142, and 143 may define the water flow path and the refrigerant flow path therein. In some examples, each of the heat exchangers 140, 141, 142, and 143 may include pipes that define the water flow path and the refrigerant flow path. In some examples, each of the heat exchangers 140, 141, 142, and 143 may include a plate that divides the water flow path and the refrigerant flow path from each other.

Referring to FIG. 2, each of the heat exchangers 140, 141, 142, and 143 may include a refrigerant flow path 141*a* and a water flow path 140*b*.

The refrigerant flow path 140*a* may be fluidly connected to the outdoor unit 10, and the refrigerant discharged from the outdoor unit 10 may be introduced into the refrigerant flow path 140*a*, or the refrigerant passing through the refrigerant flow path 140*a* may be introduced into the outdoor unit 10.

Each of the water flow path 140*b* may be connected to each of the indoor units 61, 62, 63, and 64, and the water discharged from each of the indoor units 61, 62, 63, and 64 may be introduced into the water flow path 140*b*, and then the water passing through the water flow path 140*b* may be introduced into each of the indoor units 61, 62, 63, and 64.

The heat exchange device 100 may include a first branch pipe 101*a* and a second branch pipe 102*a*, which are branched from the first connection pipe 20. The first branch pipes 101*a* and the second branch pipes 102*a* may be provided with first valves 101 and 102, respectively. However, the number of branch pipes branched from the first connection pipe 20 is not limited.

The heat exchange device 100 may include a third branch pipe 103*a* and a fourth branch pipe 104*a*, which are branched from the second connection pipe 25. The third branch pipe 103*a* and the fourth branch pipe 104*a* may be provided with second valves 103 and 104, respectively. However, the number of branch pipes branched from the second connection pipe 25 is not limited.

The heat exchange device 100 includes a first common gas pipe 111 to which the first branch pipe 101*a* and the third branch pipe 103*a* are connected and a second common gas pipe 112 to which the second branch pipe 102*a* and the fourth branch pipe 104*a* connected.

The first common gas pipe 111 and the second common gas pipe 112 may communicate with each other.

The heat exchangers 140, 141, 142, and 143 may include refrigerant pipes 111*a*, 111*b*, 112*a*, and 112*b* and refrigerant pipes 121, 122, 123, 124, which communicate with the refrigerant flow path 140*a*, respectively. For example, the first heat exchanger 140 may be connected to the first refrigerant pipe 111*a* and the second refrigerant pipe 121, and the second heat exchanger 141 may be connected to the third refrigerant pipe 111*b* and the fourth refrigerant pipe 122. The third heat exchanger 142 may be connected to the fifth refrigerant pipe 112*a* and the sixth refrigerant pipe 123, and the fourth heat exchanger 143 may be connected to the seventh refrigerant pipe 112*b* and the eighth refrigerant pipe 124.

The first refrigerant pipe 111*a* of the first heat exchanger 140 and the third refrigerant pipe 111*b* of the second heat exchanger 141 may communicate with the first common gas pipe 111.

A first check valve 132 may be provided in a pipe connected between the first refrigerant pipe 111*a* of the first heat exchanger 140 and the third refrigerant pipe 111*b* of the second heat exchanger 141 in the first common gas pipe 111 or in the third refrigerant pipe 111*b* of the second heat exchanger 141.

The first check valve 132 allows the refrigerant of the third refrigerant pipe 111*b* of the second heat exchanger 141 to flow toward the first refrigerant pipe 111*a* of the first heat exchanger 140. In some examples, the first check valve 132 blocks a flow of the refrigerant of the first refrigerant pipe 111*a* of the first heat exchanger 140 toward the third refrigerant pipe 111*b* of the second heat exchanger 141.

The fifth refrigerant pipe 112*a* of the third heat exchanger 142 and the seventh refrigerant pipe 112*b* of the fourth heat exchanger 143 may communicate with the second common gas pipe 112.

A second check valve 137 may be provided in a pipe connected between the fifth refrigerant pipe 112*a* of the third heat exchanger 142 and the seventh refrigerant pipe 112*b* of the fourth heat exchanger 143 in the second common gas pipe 112 or in the seventh refrigerant pipe 112*b* of the fourth heat exchanger 143.

The second check valve 137 allows the refrigerant of the seventh refrigerant pipe 112*b* of the fourth heat exchanger 143 to flow to the fifth refrigerant pipe 112*a* of the third heat exchanger 142. The second check valve 137 may block a flow of the refrigerant in the fifth refrigerant pipe 112*a* of the third heat exchanger 142 into the seventh refrigerant pipe 112*b* of the fourth heat exchanger 143.

The refrigerant pipes 121, 122, 123, and 124 may be connected to the third connection pipe 27.

Expansion valves 125, 126, 127, and 128 may be provided in the refrigerant pipes 121, 122, 123, and 124 of the heat exchangers 140, 141, 142, and 143, respectively.

Each of the expansion valves 125, 126, 127, and 128 may include, for example, an electronic expansion valve (EEV).

The EEV may adjust a degree of opening thereof to allow a pressure of the refrigerant passing through the expansion valve to drop down. For example, when the expansion valve is fully opened, the refrigerant may pass through the expansion valve without dropping down, and when the degree of opening of the expansion valve decreases, the refrigerant may be decompressed. A degree of decompression of the refrigerant may increase as the degree of opening decreases.

The second refrigerant pipe 121 of the first heat exchanger 140 and the third refrigerant pipe 111*b* of the second heat exchanger 141 may be connected to each other by the first bypass pipe 130.

The first bypass pipe 130 may be connected to a pipe between the first expansion valve 125 and the refrigerant flow path 140*a* of the first heat exchanger 140 in the second refrigerant pipe 121. A first bypass valve 131 may be provided in the first bypass pipe 130.

The sixth refrigerant pipe 123 of the third heat exchanger 142 and the seventh refrigerant pipe 112*b* of the fourth heat exchanger 143 may be connected to each other by a second bypass pipe 135.

The second bypass pipe 135 may be connected to a pipe between the third expansion valve 127 and the refrigerant flow path 140*a* of the third heat exchanger 142 in the sixth refrigerant pipe 123. The second bypass pipe 135 may be provided with a second bypass valve 136.

The heat exchange device 100 may further include heat exchanger inlet pipes 161*a*, 161*b*, 163*a*, and 163*b* and heat exchanger outlet pipes 162*a*, 162*b*, 164*a*, and 164*b*, which are connected to the water flow path 140*b* of the heat exchanger 140, 141, 142, and 143.

The first heat exchanger inlet pipe 161*a* of the first heat exchanger 140 and the second heat exchanger inlet pipe 161*b* of the second heat exchanger 141 may be branched from a first common inlet pipe 161. A first pump 151 may be provided in the first common inlet pipe 161.

The third heat exchanger inlet pipe 163*a* of the third heat exchanger 142 and the fourth heat exchanger inlet pipe 163*b* of the fourth heat exchanger 143 may be branched from a second common inlet pipe 163. The second pump 152 may be provided in the second common inlet pipe 163.

The first heat exchanger outlet pipe 162*a* of the first heat exchanger 140 and the second heat exchanger outlet pipe 162*b* of the second heat exchanger 141 may be connected to a first common outlet pipe 162.

The third heat exchanger outlet pipe 164*a* of the third heat exchanger 142 and the fourth heat exchanger outlet pipe 164*b* of the fourth heat exchanger 143 may be connected to a second common outlet pipe 164.

In some examples, a first combination pipe 181 may be connected to the first common inlet pipe 161. A second combination pipe 182 may be connected to the second common inlet pipe 163.

In some examples, a third combination pipe 183 may be connected to the first common outlet pipe 162. A fourth combination pipe 184 may be connected to the second common outlet pipe 164.

In some examples, a first water outlet pipe 171 through which water discharged from each of the indoor heat exchangers 61*a*, 62*a*, 63*a*, and 64*a* flows may be connected to the first combination pipe 181.

A second water outlet pipe 172 through which water discharged from the indoor heat exchangers 61*a*, 62*a*, 63*a*, and 64*a* flows may be connected to the second combination pipe 182.

The first water outlet pipe 171 and the second water outlet pipe 172 may be disposed in parallel to each other and be connected to the common water outlet pipes 612, 622, 632, and 642 communicating with the indoor heat exchangers 61*a*, 62*a*, 63*a*, and 64*a*.

The first water outlet pipe 171, the second water outlet pipe 172, and each of the common water outlet pipes 612, 622, 632, and 642 may be connected to each other by, for example, a three-way valve 173.

Accordingly, the water of the common water outlet pipe 612, 622, 632, and 642 may flow through one of the first water outlet pipe 171 and the second water outlet pipe 172 by the three-way valve 173.

The common water outlet pipes 612, 622, 632, and 642 may be connected to the outlet pipes of the indoor heat exchangers 61*a*, 62*a*, 63*a*, and 64*a*, respectively.

First water inlet pipes 165*a*, 165*b*, 165*c*, and 165*d* through which water to be introduced into each indoor heat exchanger 61*a*, 62*a*, 63*a*, and 64*a* flows may be connected to the third combination pipe 183.

A second water inlet pipe 167*d* through which water to be introduced into each of the indoor heat exchangers 61*a*, 62*a*, 63*a*, and 64*a* flows may be connected to the fourth combination pipe 184.

The first water inlet pipes 165*a*, 165*b*, 165*c*, and 165*d* and the second water inlet pipe 167*d* may be arranged in parallel to each other and be connected to the common inlet pipes 611, 621, 631, and 641 communicating with the indoor heat exchangers 61*a*, 62*a*, 63*a*, and 64*a*.

Each of the first water inlet pipes 165*a*, 165*b*, 165*c*, and 165*d* may be provided with a first valve 166, and the second water inlet pipes 167*d* may be provided with a second valve 167.

Figure 3:
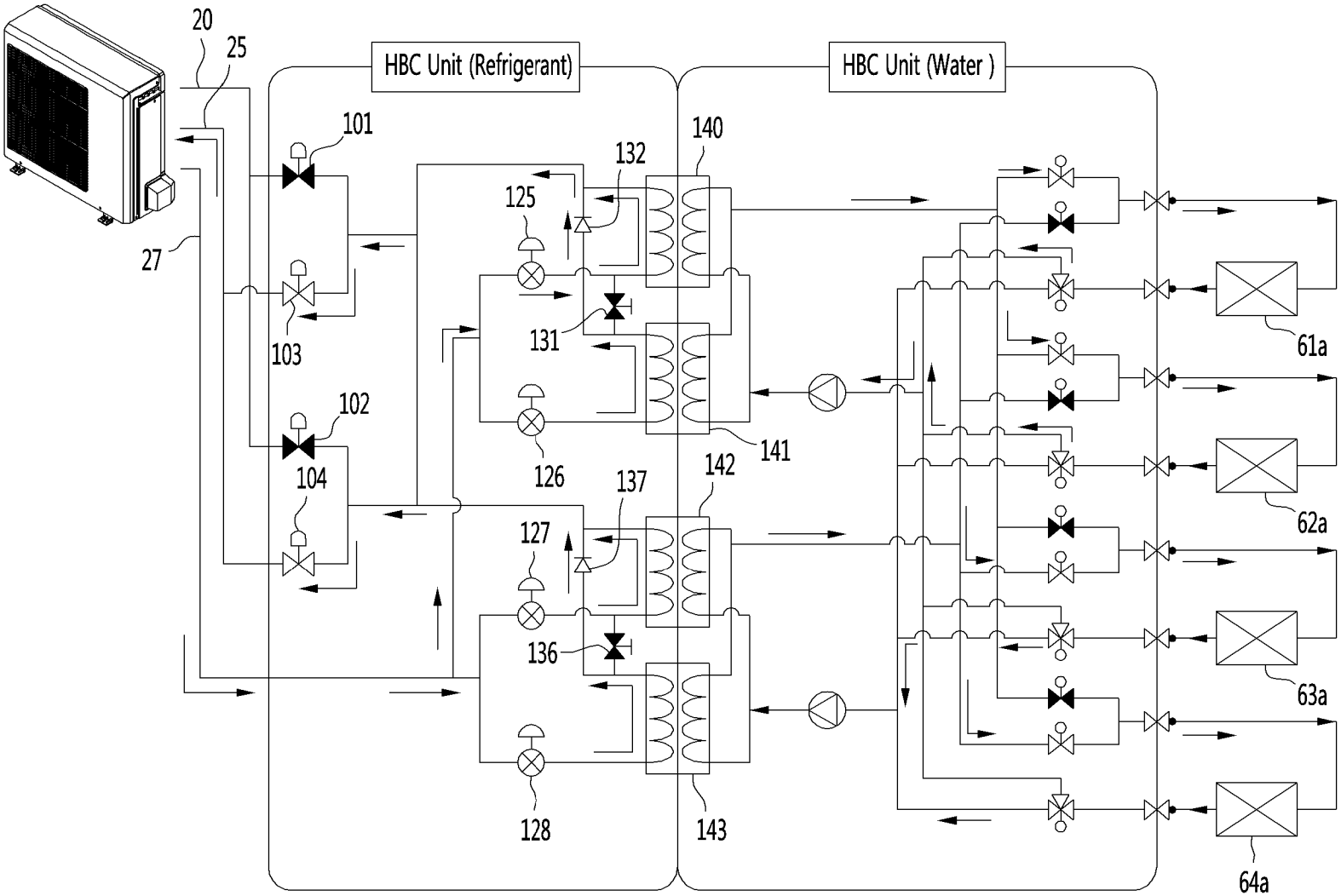
FIG. 3 is a cycle diagram illustrating an example of flows of refrigerant and water in an example heat exchange device during a cooling operation of the air conditioning apparatus.

FIG. 3 is a cycle diagram illustrating an example of flows of the refrigerant and the water in the heat exchange device during the cooling operation of the air conditioning apparatus.

Referring to FIGS. 2 and 3, when the air conditioning apparatus 1 performs the heating operation (the plurality of indoor units operate to perform the heating operation), the high-pressure liquid refrigerant condensed in the outdoor heat exchanger 15 of the outdoor unit 10 may flow to the third connection pipe 27 and then be branched into the refrigerant pipes 121, 122, 123, and 124.

In this case, since the expansion valves 125, 126, 127, and 128 provided in the refrigerant pipes 121, 122, 123, and 124 are opened to a predetermined opening degree, the refrigerant may be decompressed into a low-pressure refrigerant while passing through the expansion valves 125, 126, 127, and 128.

The decompressed refrigerant may be heat-exchanged with the water and thus be evaporated while flowing along the refrigerant flow path 141*a* of the heat exchangers 140, 141, 142 and 143.

The bypass valves 131 and 136 are in a closed state while the air conditioning apparatus 1 performs the cooling operation.

Therefore, a flow of the refrigerant heat-exchanged while passing through the refrigerant flow path 140*a* of the second heat exchanger 141 into the second refrigerant pipe 121 of the first heat exchanger 141 through the first bypass pipe 130 may be prevented. Also, a flow of the refrigerant heat-exchanged while passing through the refrigerant flow path 140*a* of the fourth heat exchanger 143 into the sixth refrigerant pipe 123 of the third heat exchanger 142 through the second bypass pipe 135 may be prevented.

The refrigerant flowing through the refrigerant flow path 140*a* of the first and second heat exchangers 140 and 141 may flow to the first common gas pipe 111 after passing through the first refrigerant pipe 111*a* and third refrigerant pipe 111*b*. The refrigerant flowing into the first common gas pipe 111 flows to the second connection pipe 25 by the third branch pipe 103*a*.

The refrigerant flowing through the refrigerant flow paths 140*a* of the third and fourth heat exchangers 142 and 143 may flow to the second common gas pipe 112 after passing through the fifth refrigerant pipe 112*a* and the seventh refrigerant pipe 112*b*. The refrigerant flowing into the second common gas pipe 112 flows to the second connection pipe 25 by the fourth branch pipe 104*a*.

While the air conditioning apparatus 1 performs the cooling operation, the valves 101 and 102 of the first branch pipe 101*a* and the second branch pipe 102*a* are closed, and the valves 103 and 104 of the third branch pipe 103*a* and the fourth branch are opened.

The refrigerant discharged into the second connection pipe 25 may be introduced into the outdoor unit 10 and be suctioned into the compressor 11. The high-pressure refrigerant compressed by the compressor 11 may be condensed in the outdoor heat exchanger 15, and the condensed liquid refrigerant may again flow along the third connection pipe 27.

In summary, during the cooling operation of the air conditioning apparatus 1, each of the heat exchangers 140, 141, 142, and 143 serves as an "evaporator" for evaporating the refrigerant in an abnormal state having a low pressure.

Since the heat exchangers 140, 141, 142, and 143 are connected in parallel to each other, a length of the flow path of the refrigerant to be evaporated may be short, and the number of refrigerant paths may increase. Therefore, the reduction of the evaporation pressure may be prevented, and the performance of the refrigerant cycle may be improved.

The water flowing through the water flow path 140*b* of each of the heat exchangers 140, 141, 142, and 143 may be cooled by the heat exchange with the refrigerant, and the cooled water may be supplied to each of the indoor heat exchangers 61*a*, 62*a*, and 63*a*, and 64*a* to perform the cooling.

In some implementations, the water discharged to the first common outlet pipe 162 may flow to the first indoor heat exchanger 61*a* and the second indoor heat exchanger 62*a*. In some examples, the water discharged to the second common outlet pipe 164 may flow to the third indoor heat exchanger 63*a* and the fourth indoor heat exchanger 64*a*.

For example, the water discharged to the first common outlet pipe 162 may flow to the first indoor heat exchanger

61*a* and the second indoor heat exchanger 62*a* through the first water inlet pipes 165*a* and 165*b*.

In some examples, the water discharged to the second common outlet pipe 164 may flow to the third indoor heat exchanger 63*a* and the fourth indoor heat exchanger 64*a* through the second water inlet pipe 167*d*.

The water flowing through each of the indoor heat exchangers 61*a*, 62*a*, 63*a*, and 64*a* may be heat-exchanged with indoor air blown by the indoor heat exchanger.

In each of the heat exchangers 140, 141, 142, and 143, since the water heat-exchanged with the refrigerant is in a low-temperature state, when the indoor air and the water are heat-exchanged with each other while flowing the indoor heat exchangers 61*a*, 62*a*, 63*a*, and 64*a*, the indoor air may be cooled to perform the indoor cooling.

In some implementations, the water flowing through the first and second indoor heat exchangers 61*a* and 62*a* may flow to the first common inlet pipe 161.

For example, the water flowing through the first and second indoor heat exchangers 61*a* and 62*a* may flow along the first water outlet pipe 171 and then flow into the first common inlet pipe 161.

In some examples, the water flowing through the third and fourth indoor heat exchangers 63*a* and 64*a* may flow to the second common inlet pipe 163.

For example, the water flowing through the third and fourth indoor heat exchangers 63*a* and 64*a* may flow along the second water outlet pipe 172 and then flow into the second common inlet pipe 163.

Figure 4:
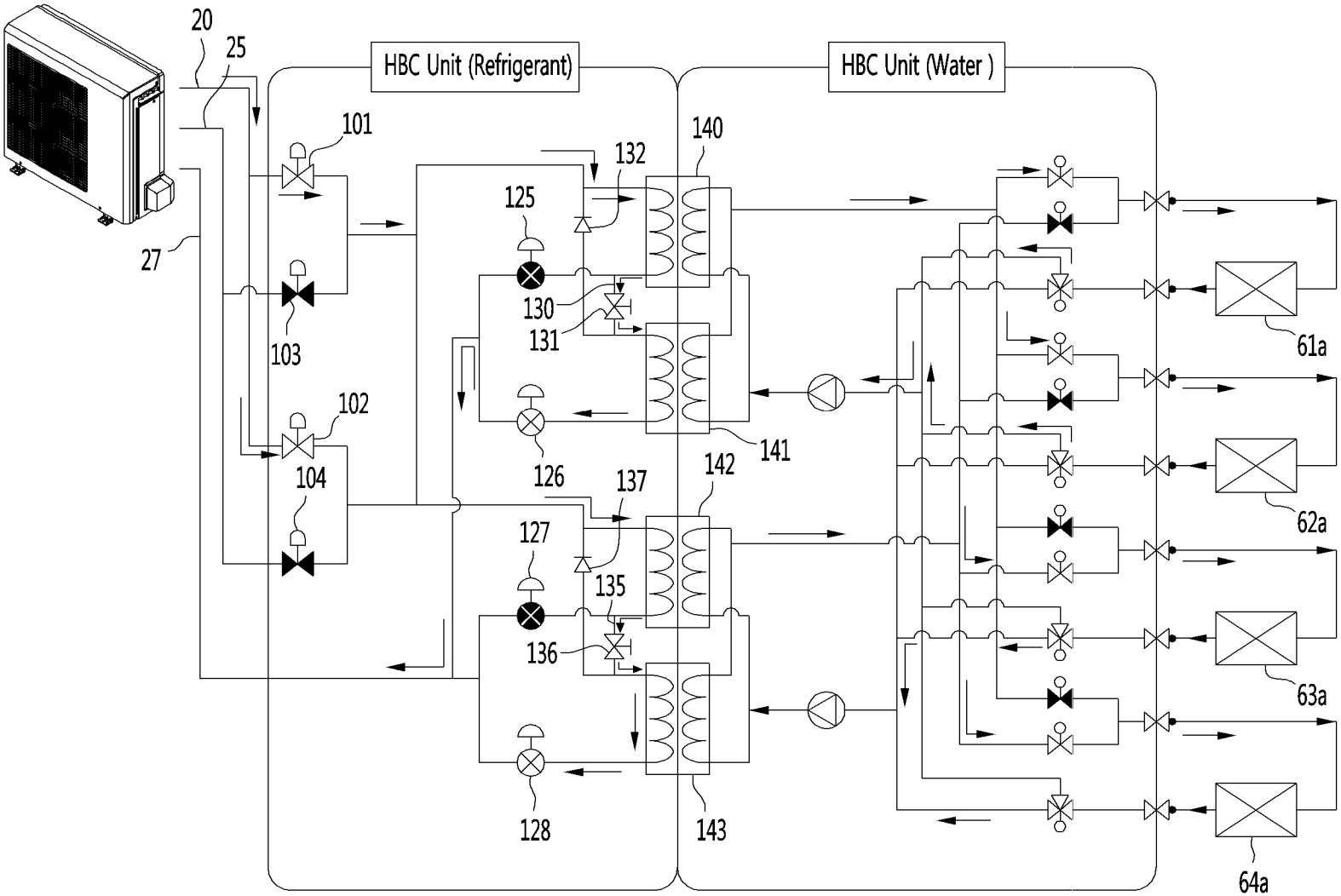
FIG. 4 is a cycle diagram illustrating an example of flows of the refrigerant and the water in the heat exchange device during a heating operation of the air conditioning apparatus.

FIG. 4 is a cycle diagram illustrating an example of flows of the refrigerant and the water in the heat exchange device during the heating operation of the air conditioning apparatus.

Referring to FIGS. 2 and 4, when the air conditioning apparatus 1 performs the heating operation (a plurality of indoor units perform the heating operation), the high-pressure gas refrigerant compressed by the compressor 11 of the outdoor unit 10 may flow to the first connection pipe 20 and then be branched into the first branch pipe 101*a* and the second branch pipe 101*b*.

When the air conditioning apparatus 1 perform the heating operation, the first valves 101 and 102 of the first and second branch pipes 101*a* and 101*b* are opened, and the second valves 103 and 104 of the third and fourth branch pipes 103*a* and 104*a* are closed.

The refrigerant branched into the first branch pipe 101*a* flows along the first common gas pipe 111 and then flows into the first refrigerant pipe 111*a* of the first heat exchanger 140.

Also, the refrigerant branched into the second branch pipe 101*b* flows along the second common gas pipe 112 and then flows into the fifth refrigerant pipe 112*a* of the third heat exchanger 142.

During the heating operation of the air conditioning apparatus 1, the first expansion valve 125 and the third expansion valve 127 may be closed, and the second expansion valve 126 and the fourth expansion valve 128 are opened to a predetermined opening degree.

In some implementations, during the heating operation of the air conditioning apparatus 1, each of the bypass valves 131 and the check valve 132 may be opened.

Accordingly, the refrigerant flowing into the first refrigerant pipe 111*a* of the first heat exchanger 140 is discharged to the second refrigerant pipe 121 after being heat-exchanged with the water while passing through the first heat exchanger 140.

Since the first expansion valve 125 is closed, and the first bypass valve 131 is opened, the refrigerant discharged to the second refrigerant pipe 121 flows to the third refrigerant pipe 111*b* of the second heat exchanger 141 by the first bypass pipe 130.

The refrigerant flowing into the third refrigerant pipe 111*b* of the second heat exchanger 141 is discharged to the fourth refrigerant pipe 122 after being heat-exchanged with the water while passing through the second heat exchanger 141.

The refrigerant discharged into the fourth refrigerant pipe 122 flows to the third connection pipe 27 after passing through the second expansion valve 126.

Also, the refrigerant flowing into the fifth refrigerant pipe 112*a* of the third heat exchanger 142 is discharged to the sixth refrigerant pipe 123 after being heat-exchanged with the water while passing through the third heat exchanger 142.

Since the third expansion valve 127 is closed, and the second bypass valve 136 is opened, the refrigerant discharged to the sixth refrigerant pipe 123 flows to the seventh refrigerant pipe 112*b* of the fourth heat exchanger 143 by the second bypass pipe 135.

The refrigerant flowing into the seventh refrigerant pipe 112*b* of the fourth heat exchanger 143 is heat-exchanged with the water while passing through the fourth heat exchanger 143 and then is discharged to the eighth refrigerant pipe 124.

The refrigerant discharged into the eighth refrigerant pipe 124 flows to the third connection pipe 27 after passing through the fourth expansion valve 128.

Since a flow of the water during the heating operation of the air conditioning apparatus 1 is the same as the flow of the water during the cooling operation, detailed description thereof will be omitted.

In summary, during the heating operation of the air conditioning apparatus 1, each of the heat exchangers 140, 141, 142, and 143 serves as a "condenser" that condenses the high-pressure gas refrigerant.

Since the first and second heat exchangers 140 and 141 are connected in series, the refrigerant may be sequentially condensed while passing through the first heat exchanger 140 and the second heat exchanger 141. Therefore, a heat amount of refrigerant to be condensed may increase to improve condensation performance.

Also, since the third and fourth heat exchangers 142 and 143 are connected in series, the refrigerant may be sequentially condensed while passing through the third heat exchanger 142 and the fourth heat exchanger 143. Therefore, a heat amount of refrigerant to be condensed may increase to improve condensation performance.

Figure 5:
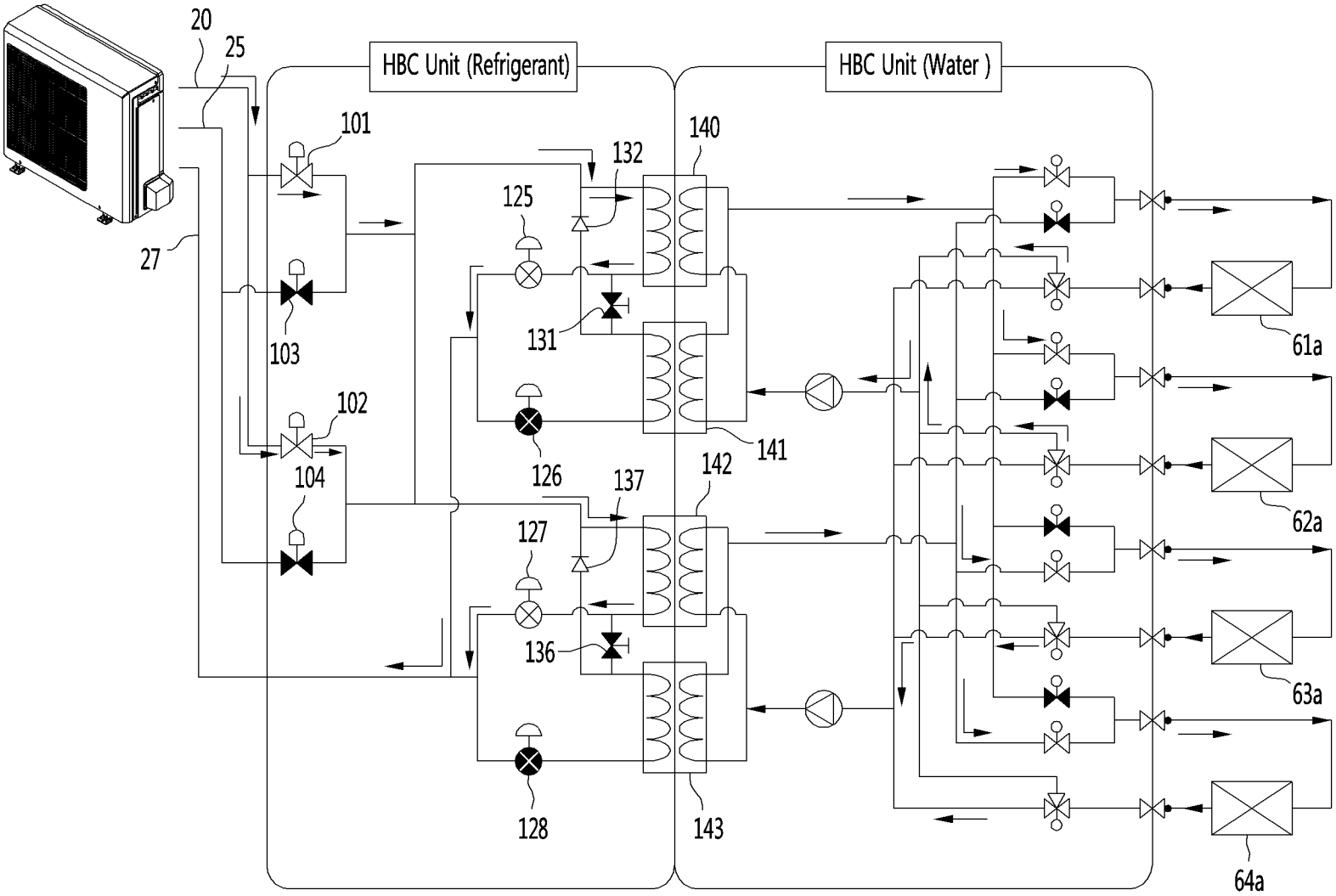
FIG. 5 is a cycle diagram illustrating an example of flows of the refrigerant and the water when some of a plurality of heat exchangers operate during the heating operation of the air conditioning apparatus.

FIG. 5 is a cycle diagram illustrating an example of flows of the refrigerant and the water when some of a plurality of heat exchangers operate during the heating operation of the air conditioning apparatus.

Referring to FIGS. 2 and 5, when the number of indoor units, in which the heating operation is performed, is small, or a heating load of the indoor units is small, only some of the plurality of heat exchangers may be used as the evaporator.

In FIG. 5, the first heat exchanger 140 and the third heat exchanger 142 are used as condensers.

When the air conditioning apparatus 1 performs the heating operation, the high-pressure gas refrigerant compressed by the compressor 11 of the outdoor unit 10 may flow to the first connection pipe 20 and then be branched into the first branch pipe 101*a* and the second branch pipe 101*b*.

When the air conditioning apparatus 1 perform the heating operation, the first valves 101 and 102 of the first and second branch pipes 101*a* and 101*b* are opened, and the second valves 103 and 104 of the third and fourth branch pipes 103*a* and 104*a* are closed.

The refrigerant branched into the first branch pipe 101*a* flows along the first common gas pipe 111 and then flows into the first refrigerant pipe 111*a* of the first heat exchanger 140.

Also, the refrigerant branched into the second branch pipe 101*b* flows along the second common gas pipe 112 and then flows into the fifth refrigerant pipe 112*a* of the third heat exchanger 142.

During the heating operation of the air conditioning apparatus 1, when only one of the first and second heat exchangers 140 and 141 is used, the first expansion valve 125 is opened, the second expansion valve 126 is closed, and the first bypass valve 131 is closed.

In some implementations, since a check valve 132 is disposed at a portion connected between the first refrigerant pipe 111*a* of the first heat exchanger 140 and the third refrigerant pipe 111*b* of the second heat exchanger 141, when the heating operation is performed, if a portion of the heat exchangers intends to be used, only the first heat exchanger 141 of the first and second heat exchangers 140 and 141 may be used.

Also, during the heating operation of the air conditioning apparatus 1, when only one of the third and fourth heat exchangers 142 and 143 is used, the third expansion valve 127 is opened, the fourth expansion valve 128 is closed, and the second bypass valve 136 is closed.

In some implementations, since a check valve 137 is disposed at a portion connected between the fifth refrigerant pipe 112*a* of the third heat exchanger 142 and the seventh refrigerant pipe 112*b* of the fourth heat exchanger 143, when the heating operation is performed, if a portion of the heat exchangers intends to be used, only the third heat exchanger 142 of the third and fourth heat exchangers 142 and 143 may be used.

The refrigerant flowing through the first heat exchanger 140 and the third heat exchanger 142 flows through the first expansion valve 125 and the third expansion valve 127 and then flows to the outdoor unit 10 through the third connection pipe 27.

Only a portion of the plurality of heat exchangers may be used during the cooling operation of the air conditioning apparatus.

In this case, the expansion valve corresponding to the heat exchanger to be used is opened, and the expansion valve corresponding to the remaining unused heat exchanger is closed. Regardless of which heat exchanger is used, the bypass valves 131 and 136 may be maintained in the closed state.

During the cooling operation, for example, even without using the first heat exchanger 140 and using the second heat exchanger 141, the first check valve 132 allows the refrigerant of the third refrigerant pipe to flows, the refrigerant flowing through the second heat exchanger 141 may flow to the first common gas pipe 111.

Figure 6:
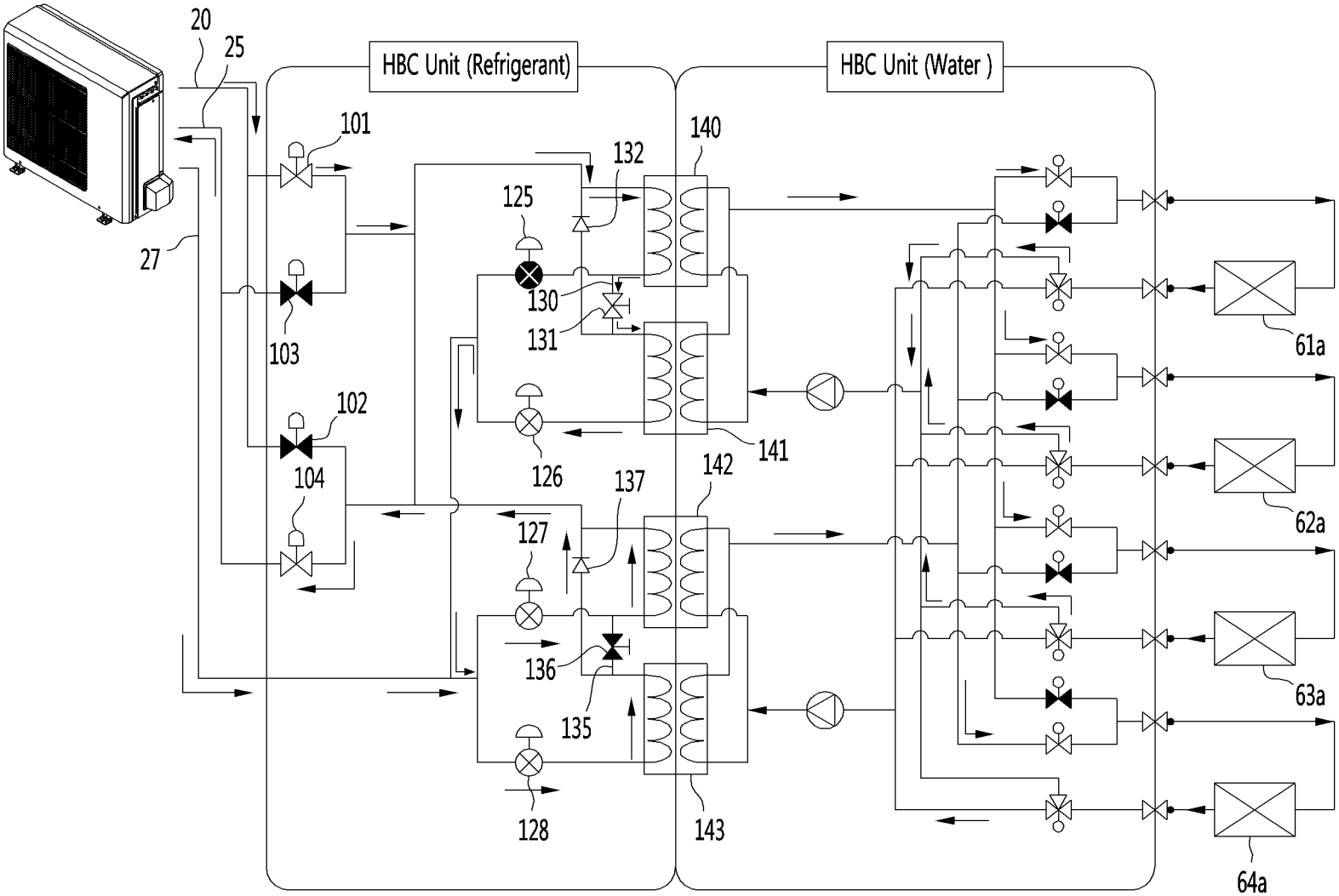
FIG. 6 is a cycle diagram illustrating an example of flows of the refrigerant and the water in the air conditioning apparatus when some of indoor units operate to perform the heating operation, and the other indoor units operate to perform the cooling operation.

FIG. 6 is a cycle diagram illustrating an example of flows of the refrigerant and the water in the air conditioning apparatus when some of indoor units operate to perform the heating operation, and the other indoor units operate to perform the cooling operation.

Referring to FIGS. 2 and 6, for example, some of the indoor units operate to perform the heating operation, and other indoor units operate to perform the cooling operation. In this case, some of the plurality of heat exchangers may serve as evaporators, and others serve as condensers.

Hereinafter, an example in which the first to third indoor units 61, 62, and 63 operate to perform the heating operation, and the fourth indoor unit 64 operates to perform the cooling operation will be described.

For example, in order that the first to third indoor units 61, 62, and 63 operate to perform the heating operation, and the fourth indoor unit 64 operates to perform the cooling operation, for example, the first and second heat exchangers 140, 141 may serve as the condensers, and the third and fourth heat exchangers 142 and 143 may serve as the evaporators.

The high-pressure gas refrigerant compressed by the compressor 11 of the outdoor unit 10 may be branched to the first branch pipe 101*a* after flowing through the first connection pipe 20.

In order the first and second heat exchangers 140 and 141 serve as the condensers, the valve 101 of the first branch pipe 101*a* may be opened, and the valve 103 of the third branch pipe 103*a* may be closed. The first expansion valve 125 may be closed, and the second expansion valve 126 may be opened to a predetermined opening degree. The first bypass valve 131 may be opened.

Then, the refrigerant of the first branch pipe 101*a* flows along the first common gas pipe 111 and then flows to the first refrigerant pipe 111*a* of the first heat exchanger 140.

The refrigerant flowing into the first refrigerant pipe 111*a* of the first heat exchanger 140 is discharged to the second refrigerant pipe 121 after being heat-exchanged with the water while passing through the first heat exchanger 140.

The refrigerant discharged into the second refrigerant pipe 121 flows to the third refrigerant pipe 111*b* of the second heat exchanger 141 by the first bypass pipe 130.

The refrigerant flowing into the third refrigerant pipe 111*b* of the second heat exchanger 141 is discharged to the fourth refrigerant pipe 122 after being heat-exchanged with the water while passing through the second heat exchanger 141.

The refrigerant discharged into the fourth refrigerant pipe 122 is mixed with the liquid refrigerant flowing into the third connection pipe 27 after passing through the second expansion valve 126.

In some examples, the high-pressure liquid refrigerant condensed in the outdoor heat exchanger 15 of the outdoor unit 10 may be distributed to the refrigerant pipes 123 and 124 after flowing through the third connection pipe 27.

In order that the third and fourth heat exchangers 142 and 143 serve as the evaporators, each of the third expansion valve 127 and the fourth expansion valve 128 is opened to a predetermined degree. The second bypass valve 136 is closed.

Therefore, the refrigerant may be decompressed into a low-pressure refrigerant while passing through the third and fourth expansion valves 127 and 128.

The decompressed refrigerant may be evaporated through the heat exchange with the water while flowing along the refrigerant paths of the third and fourth heat exchangers 142 and 143.

The refrigerant flowing through the refrigerant flow paths of the third and fourth heat exchangers 142 and 143 may flow into the second common gas pipe 112 after passing through the fifth refrigerant pipe 112*a* and the seventh refrigerant pipe 112*b*. The refrigerant flowing into the second common gas pipe 112 flows to the second connection pipe 25 by the fourth branch pipe 104*a*.

The refrigerant discharged into the second connection pipe 25 may be introduced into the outdoor unit 10 and be suctioned into the compressor 11. The high-pressure refrigerant compressed by the compressor 11 may be condensed in the outdoor heat exchanger 15, and the condensed liquid refrigerant may again flow along the third connection pipe 27.

The water flowing in the water flow paths of the first and second heat exchangers 140 and 141 is heated by the heat exchange with the refrigerant, and the water flowing to the water flow paths of the third and fourth heat exchangers 143 and 143 is cooled by the heat exchange with the refrigerant.

In order that the first to third indoor units 61, 62, and 63 operate to perform the heating operation, the water discharged to the first common outlet pipe 162 may flow to the first to third indoor heat exchangers 61*a*, 62*a*, and 63*a*.

In some examples, in order that the fourth indoor unit 64 operates to perform the cooling operation, the water discharged to the second common outlet pipe 164 may flow to the fourth indoor heat exchanger 64*a*.

For example, the water discharged to the first common outlet pipe 162 may pass through the first to third indoor heat exchangers 61*a*, 62*a*, and 63*a* through the first water inlet pipes 165*a*, 165*b*, and 165*c*.

In some examples, the water discharged to the second common outlet pipe 164 may flow to the fourth indoor heat exchanger 64*a* through the second water inlet pipe 167*d*.

The water flowing through each of the indoor heat exchangers 61*a*, 62*a*, 63*a*, and 64*a* may be heat-exchanged with indoor air blown by the indoor heat exchanger.

In each of the heat exchangers 140 and 141, since the water heat-exchanged with the refrigerant is in a high-temperature state, when the indoor air and the water are heat-exchanged with each other while flowing the indoor heat exchangers 61*a*, 62*a*, 63*a*, and 64*a*, the indoor air may be cooled to perform the indoor heating.

In some examples, since the water heat-exchanged with the refrigerant is in a low-temperature state, when the indoor air and the water are heat-exchanged with each other while flowing the fourth indoor heat exchanger 64*a*, the indoor air may be cooled to perform the indoor cooling.

In some implementations, the water flowing through the first to third indoor heat exchangers 61*a*, 62*a*, and 63*a* may flow toward the first common inlet pipe 161.

For example, the water flowing through the first to third indoor heat exchangers 61*a*, 62*a*, and 63*a* may flow along the first water outlet pipe 171 and then flow to the first common inlet pipe 161.

In some examples, the water flowing through the fourth indoor heat exchanger 64*a* may flow to the second common inlet pipe 163.

For example, the water flowing through the fourth indoor heat exchanger 64*a* may flow along the second water outlet pipe 172 and then flow into the second common inlet pipe 163.

In the above implementation, the heat exchange device has been described as including the first to fourth heat exchangers. However, unlike this, the heat exchange device may include at least the first heat exchanger and the second heat exchanger. In this case, the valves provided in the second branch pipe, the fourth branch pipe, and the corresponding branch pipe may be omitted.

In some implementations, the pipes and the valves, which are configured so that all of the plurality of heat exchangers serve as the condensers, all of the plurality of heat exchangers serve as the evaporators, or some of the plurality of heat exchangers serve as the condensers, and others serve as the evaporators, may be referred to as a refrigerant flow path variable part or a refrigerant passage.

The refrigerant flow path variable part may allow the refrigerant flow path to vary so that the refrigerant parallely flows through the plurality of heat exchangers when the cooling operation of the indoor units is performed. For example, the refrigerant may be guided by multiple pipes and provided to the plurality of heat exchangers, respectively.

In some examples, the refrigerant flow path variable part may allow the refrigerant flow path to vary so that the refrigerant sequentially flows through the plurality of heat exchangers when the heating operation of the indoor units is performed. For example, the refrigerant may be provided from one heat exchanger to another heat exchanger in series.

For example, the water flow path variable part may refer to a water passage including pipes and valves. The pipes and valves may be configured to allow the water flow path to vary so that all of the plurality of indoor units operate to perform the heating operation, all of the plurality of indoor units operate to perform the cooling operation, or some of the plurality of indoor units operate to perform the heating operation, and others operate to perform the cooling operation.

In some implementations, the water flow path variable part may allow the water flow path to vary so that the water may flow to the heat exchanger that serves as a condenser when the indoor unit operates to perform the heating operation and may flow to the heat exchanger that serves as an evaporator when the indoor unit operates to perform the cooling operation.

That is, the refrigerant passage may vary in the heat exchange device during the cooling operation or the heating operation to improve the performance.

When the plurality of heat exchangers, which are provided in the heat exchange device, act as the evaporators during the cooling operation, the refrigerant may be branched and introduced into the plurality of heat exchangers to increase in number of refrigerant flow paths and reduce the length of each of the refrigerant flow paths (parallel connection between the heat exchangers), thereby preventing the evaporation pressure from being reduced.

When the plurality of heat exchangers act as the condensers during the heating operation, refrigerant may sequentially pass through the plurality of heat exchangers to increase in length and reduce in number of refrigerant flow paths (series connection between the heat exchangers), thereby improving the condensation performance in the heat exchangers.

Also, when the outdoor unit and the heat exchanger are connected to each other by three pipes, the cooling operation and the heating operation may be simultaneously performed. Here, some indoor units may operate to perform the heating operation, and other indoor units may operate to perform the cooling operation.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:

an outdoor unit configured to circulate refrigerant;

an indoor unit configured to circulate water; and a heat exchange device that connects the indoor unit to the outdoor unit and that is configured to perform heat exchange between the refrigerant and the water, the heat exchange device comprising:

a first heat exchanger and a second heat exchanger, a first refrigerant pipe and a second refrigerant pipe that are connected to the first heat exchanger, a third refrigerant pipe and a fourth refrigerant pipe that are connected to the second heat exchanger, a check valve that is disposed at the third refrigerant pipe or that is disposed at a pipe that connects the third refrigerant pipe to the first refrigerant pipe, a first expansion valve disposed at the second refrigerant pipe, a second expansion valve disposed at the fourth refrigerant pipe, a bypass pipe that connects the second refrigerant pipe to the third refrigerant pipe, and a bypass valve disposed at the bypass pipe.

2. The air conditioning apparatus of claim 1, wherein the first heat exchanger defines a first refrigerant flow path that is configured to circulate the refrigerant and that includes the first refrigerant pipe and the second refrigerant pipe, and wherein the bypass pipe is connected to a portion between the first expansion valve and the first refrigerant flow path at the second refrigerant pipe.

3. The air conditioning apparatus of claim 2, wherein the check valve is configured to restrict flow of the refrigerant from the first refrigerant pipe to the third refrigerant pipe and to allow flow of the refrigerant from the third refrigerant pipe to the first refrigerant pipe.

4. The air conditioning apparatus of claim 2, wherein the indoor unit is configured to perform a cooling operation in a state in which the first expansion valve and the second expansion valve are opened, and the bypass valve is closed, wherein the first heat exchanger is configured to, based on the indoor unit performing the cooling operation, receive the refrigerant from the outdoor unit through the second refrigerant pipe and supply the refrigerant from the second refrigerant pipe to the first refrigerant pipe, and wherein the second heat exchanger is configured to, based on the indoor unit performing the cooling operation, receive the refrigerant discharged from the outdoor unit through the fourth refrigerant pipe and supply the refrigerant from the fourth refrigerant pipe to the third refrigerant pipe.

5. The air conditioning apparatus of claim 4, wherein the check valve is configured to, based on the indoor unit performing the cooling operation, be opened to transmit the refrigerant discharged from the second heat exchanger to the first heat exchanger.

6. The air conditioning apparatus of claim 4, wherein the heat exchange device is configured to, based on the indoor unit performing the cooling operation, operate the second heat exchanger while the first heat exchanger is not operated in a state in which the second expansion valve is opened, and the first expansion valve and the bypass valve are closed.

7. The air conditioning apparatus of claim 6, wherein the check valve is configured to, in a state in which the second heat exchanger is operated and the first heat exchanger is not operated, be opened to transmit the refrigerant from the second heat exchanger to the first heat exchanger.

8. The air conditioning apparatus of claim 6, wherein the heat exchange device is configured to, based on the indoor unit performing the cooling operation, operate the first heat exchanger while the second heat exchanger is not operated in a state in which the first expansion valve is opened, and the second expansion valve and the bypass valve are closed.

9. The air conditioning apparatus of claim 2, wherein the indoor unit is configured to perform a heating operation in a state in which the first expansion valve is closed and the second expansion valve and the bypass valve are opened, and wherein the heat exchange device is configured to, based on the indoor unit performing the heating operation, supply the refrigerant from the first heat exchanger to the second heat exchanger.

10. The air conditioning apparatus of claim 2, wherein the indoor unit is configured to perform a heating operation in a state in which the first expansion valve is opened and the second expansion valve and the bypass valve are closed, and wherein the heat exchange device is configured to, based on the indoor unit performing the heating operation, operate one of the first heat exchanger or the second heat exchanger.

11. The air conditioning apparatus of claim 2, wherein the first heat exchanger defines a first water flow path that is configured to circulate the water to exchange heat with the refrigerant in the first refrigerant flow path, wherein the second heat exchanger defines a second water flow path that is configured to circulate the water to exchange heat with the refrigerant in the second heat exchanger, and wherein the indoor unit is configured to receive the water through the first water flow path and the second water flow path.

12. The air conditioning apparatus of claim 1, further comprising:

a first connection pipe that is connected to the outdoor unit and that is configured to guide the refrigerant in a high-pressure gas state;

a second connection pipe that is connected to the outdoor unit and that is configured to guide the refrigerant in a low-pressure gas state; and a third connection pipe that is connected to the outdoor unit and that is configured to guide the refrigerant in a liquid state.

13. The air conditioning apparatus of claim 12, further comprising:

a first branch pipe connected to the first connection pipe;

a second branch pipe connected to the second connection pipe; and a common gas pipe disposed between the first branch pipe and the second branch pipe, the common gas pipe having a first end that is connected to the first branch pipe and to the second branch pipe and a second end that is connected to the first refrigerant pipe and to the third refrigerant pipe.

14. The air conditioning apparatus of claim 13, wherein the third connection pipe is connected to the second refrigerant pipe and to the fourth refrigerant pipe.

15. The air conditioning apparatus of claim 13, further comprising a first valve disposed at the first branch pipe, and a second valve disposed at the second branch pipe.

16. The air conditioning apparatus of claim 1, wherein the check valve is disposed at the third refrigerant pipe.

17. The air conditioning apparatus of claim 1, wherein the check valve is disposed at the pipe that connects the third refrigerant pipe to the first refrigerant pipe.

* * * * *